US009433253B2

(12) United States Patent
McKinney

(10) Patent No.: US 9,433,253 B2
(45) Date of Patent: Sep. 6, 2016

(54) VISOR ASSEMBLY FOR A HELMET

(71) Applicant: Gregory Neal McKinney, Morrison, CO (US)

(72) Inventor: Gregory Neal McKinney, Morrison, CO (US)

(73) Assignee: MF Designco, LLC, Gig Harbor, WA (US)

( * ) Notice: Subject to any disclaimer, the term of this patent is extended or adjusted under 35 U.S.C. 154(b) by 81 days.

(21) Appl. No.: 14/284,096

(22) Filed: May 21, 2014

(65) Prior Publication Data

US 2014/0345037 A1 Nov. 27, 2014

Related U.S. Application Data

(60) Provisional application No. 61/826,202, filed on May 22, 2013.

(51) Int. Cl.
*A42B 3/22* (2006.01)

(52) U.S. Cl.
CPC ..... *A42B 3/227* (2013.01)

(58) Field of Classification Search
CPC ..... A42B 3/227; A42B 1/065; A42B 3/32
See application file for complete search history.

(56) References Cited

U.S. PATENT DOCUMENTS

| | | | | |
|---|---|---|---|---|
| 2,815,508 A | | 12/1957 | Finken | |
| 3,400,407 A | | 9/1968 | Aileo | |
| 3,495,273 A | | 2/1970 | Aileo | |
| 4,170,042 A | * | 10/1979 | Aileo | A42B 3/228 2/424 |
| 4,519,099 A | * | 5/1985 | Kamiya | A42B 3/281 2/171.3 |
| 4,793,006 A | | 12/1988 | Dawson | |
| 5,075,898 A | | 12/1991 | Bedient | |
| 5,197,150 A | | 3/1993 | Bedient | |
| 5,689,830 A | | 11/1997 | Pflum | |
| 5,839,125 A | | 11/1998 | Chen | |
| 6,820,285 B2 | | 11/2004 | Bataille et al. | |
| 6,959,454 B2 | | 11/2005 | Dewinter | |
| 2010/0229288 A1 | | 9/2010 | Higgins | |
| 2015/0135416 A1 | * | 5/2015 | Hendl | A42B 3/32 2/424 |

FOREIGN PATENT DOCUMENTS

| | | |
|---|---|---|
| EP | 1393642 B1 | 7/2007 |
| WO | 2006076395 A | 7/2006 |
| WO | 2007093056 A1 | 8/2007 |

* cited by examiner

*Primary Examiner* — Anna Kinsaul
(74) *Attorney, Agent, or Firm* — McInnes & McLane, LLP

(57) ABSTRACT

A visor assembly includes a main visor secured to a helmet and a movable visor extension for increasing the operational length of the main visor to inhibit debris from striking the goggles or face of the rider during use. The visor assembly further includes a latching mechanism for maintaining the visor extension in a retracted position, a pair of biasing members for biasing the visor extension into an extended position when the latching mechanism is released, and guide tracks and guide-stops for guiding and stopping forward movement of the visor extension at the end of travel into the extended position. The visor extension is readily available to the rider to be used when needed without stopping, is positioned under the helmet visor when not needed so that it is out the way, and can be fitted onto conventional helmets.

20 Claims, 13 Drawing Sheets

VISOR ASSEMBLY FOR A HELMET

CROSS-REFERENCE TO RELATED APPLICATIONS

This application claims the benefit of U.S. Provisional Patent Application No. 61/826,202, filed May 22, 2013, now pending, the contents of which are incorporated herein by reference.

TECHNICAL FIELD

This disclosure relates generally to a visor extension for a helmet, and more particularly but not exclusively, to a visor extension for one-handed operation to selectively extend and retract the visor extension during riding to inhibit debris from striking the goggles or face of the rider.

BACKGROUND

Helmets are utilized in a number of sports to help protect the user from a variety of head injuries. While head protection is the primary feature of the helmet, other features such as comfort and functionality are also important and are designed for the particular sport or activity. For example, many helmets include climate control features, such as vents, in order to adjust the inner temperature of the helmet so as to provide the user with a more comfortable environment during use. Many helmets also include visors to protect and shade the eyes of the wearer. The design of conventional off-road motorcycle racing, or motocross, helmets includes an elongated chin and a visor portion, a chin bar, and an open face portion to allow the unhindered flow of air during the physical exertion of this type of riding. While the visor allows the rider to dip his or her head to provide some protection from flying debris during off-road riding, the open nature of the face of the helmet allows debris to enter which can hit the rider in the face or the goggles.

Typical visors utilized in motocross suffer from limitations due to the nature of the sport. For example, motocross riders must be constantly on guard to flying debris, which can hit them in the face, while also paying close attention to the ever changing off-road conditions, and other riders. The conditions of motocross can be extreme and challenging. Because of these factors, visors that are used with motocross helmets need to function in a manner not needed in many other sports or activities.

One type of motocross visor extension is disclosed in Patent Publ. No. WO 2007/093056 to Dion. In this application a visor with a moveable auxiliary peak extension (52) mounted to the underside of the visor is disclosed. The auxiliary peak extension may be manually moved by a user to extend and retract the brim between a retracted position, an intermediate position and extended position. Because the visor relies on manual dexterity of the user to extend and retract the peak extension, operation may be inhibited while riding, particularly with riders wearing gloves.

SUMMARY

Due to the rigors of off-road sports such as motocross, visors should not only provide protection from debris, but should also be durable, comfortable and easy to operate one-handed while riding. Although conventional visors of motocross helmets provide limited protection from debris, they do not provide ideal or reliable protection, requiring the rider to position their head down to deflect debris, thus changing the rider's position and attention to the track. Other known visor extensions, while providing additional protection from debris and sun, are not easily operated particularly by riders wearing gloves. In addition, because helmets are designed for head protection, it is desirable that any visor extension utilized does not change the structure of the helmet itself, and possibly alter its effectiveness. Hence, there is a continued need in the art for an improved visor that can be used in off-road sports such as motocross, and which protects a rider from debris while also being easy to operate while riding.

The visor assembly of the present application includes a visor extension that is designed for easy, one-handed operation during off-road riding, such as motocross racing or mountain biking, and can be used to extend the operational length of a conventional helmet visor. The extension is biased for smooth, automatic extension which allows the rider to maintain their riding position during use, so as to not raise or stiffen their upper body and neck in order to slide the extension to the extended position. Engaging an actuation member to release a latching mechanism allows for easy, one-handed operation of the visor extension. The visor extension is readily available to the rider to be used when needed without stopping, is positioned under the helmet visor when not needed so that it is out the way, and can be fitted onto existing helmets such that it does not hinder the head protection features of the helmet. The visor extension includes a guide-stop feature that also provides for reliable extension regardless of manual dexterity of the user. In addition, the design of the visor extension allows for easy replacement in case the visor is broken or a different style visor is desired.

BRIEF DESCRIPTION OF THE DRAWINGS

The foregoing and other objects, features and advantages will be apparent from the following description of particular embodiments, as illustrated in the accompanying drawings in which like reference characters refer to the same parts throughout the different views. The drawings are not necessarily to scale, emphasis instead being placed upon illustrating the principles disclosed herein.

DETAILED DESCRIPTION OF THE ILLUSTRATIVE EMBODIMENTS

Figure 1:
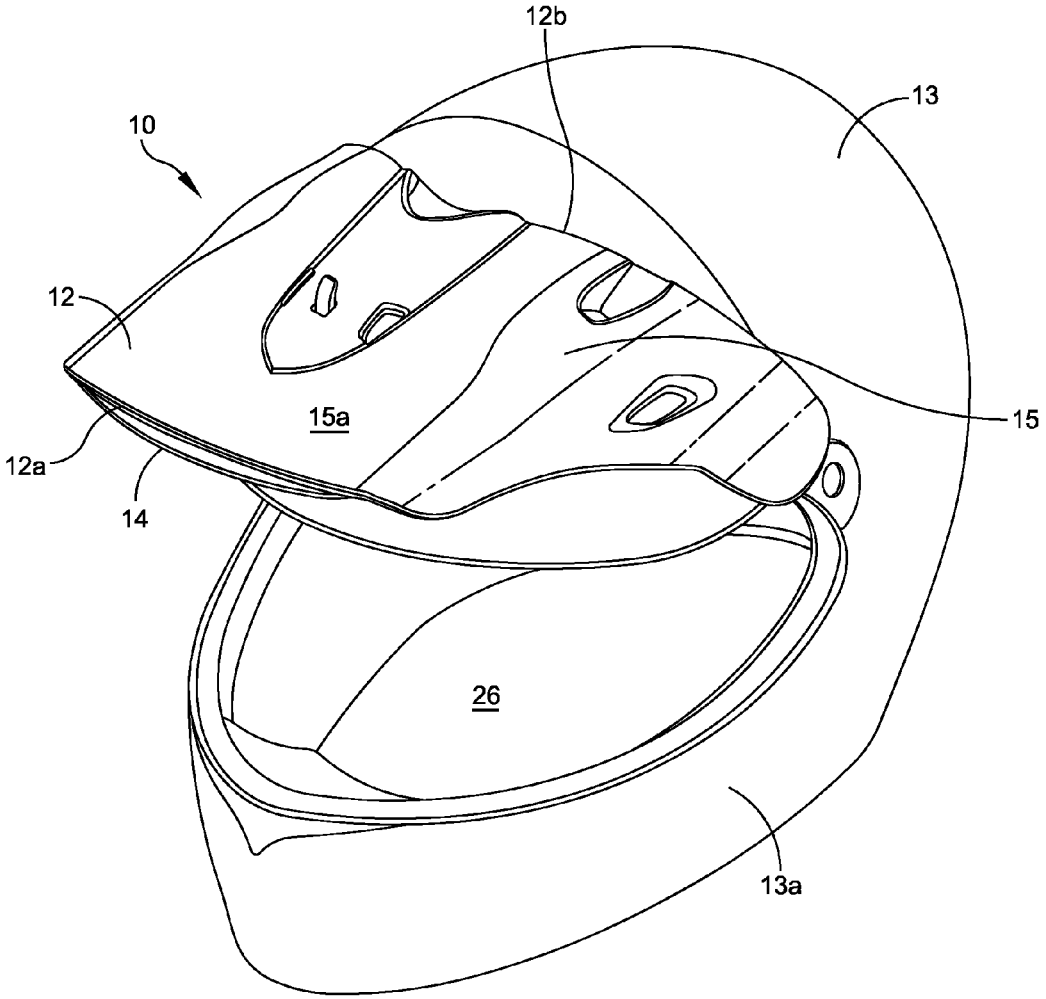
FIG. 1 is a front, perspective view of a helmet with a visor assembly according to the present disclosure in a retracted position.
Figure 2:
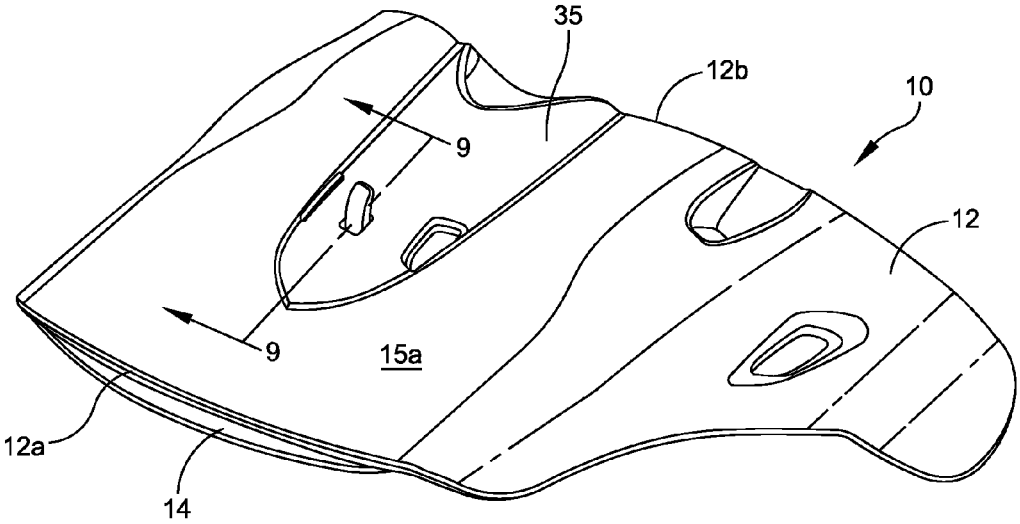
FIG. 2 is a top, perspective view of the visor assembly of FIG. 1.
Figure 3:
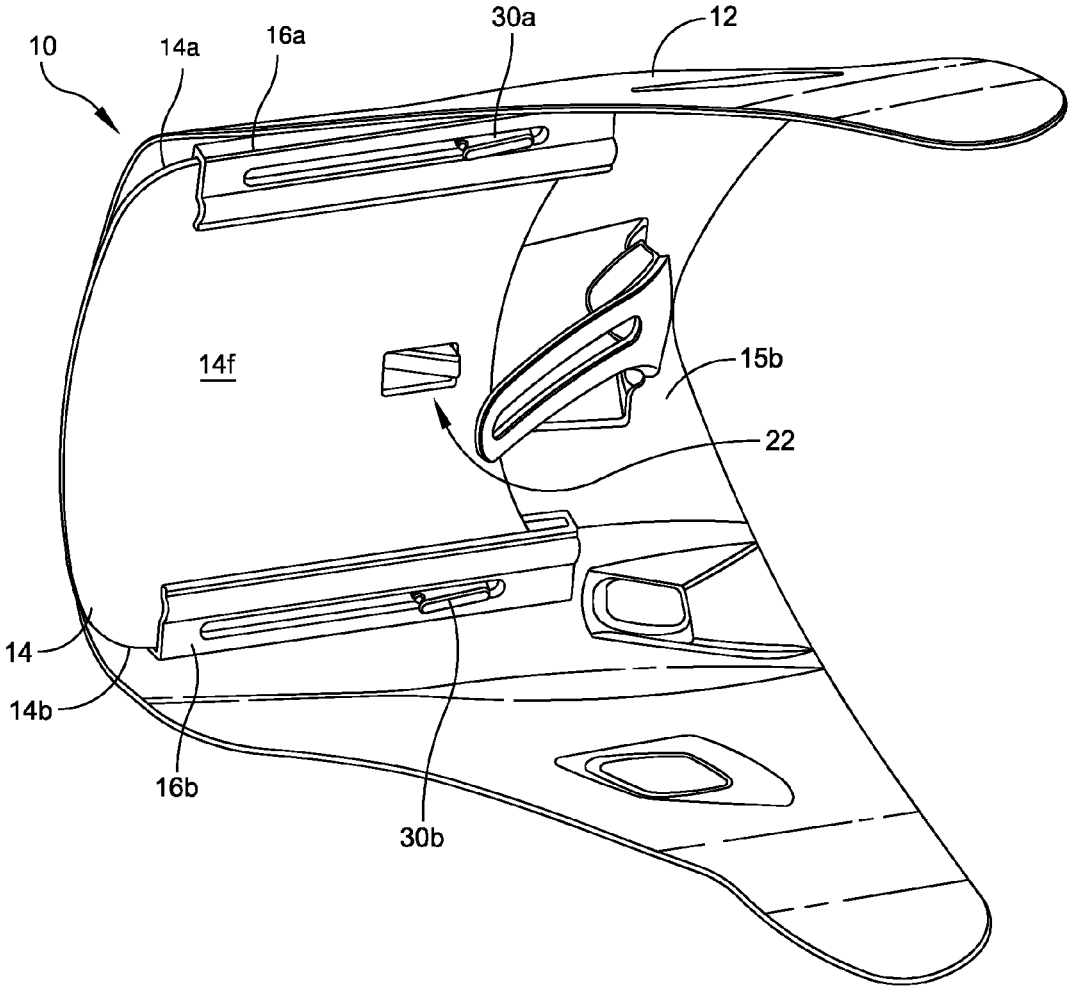
FIG. 3 is a bottom, perspective view of the visor assembly of FIG. 1.

Referring initially to FIGS. 1-3, an exemplary visor assembly 10 including a main, stationary visor 12 secured to a helmet 13 and a movable visor extension 14 for extending the operational length of stationary visor 12 is illustrated. The visor assembly 10 further includes guide tracks 16*a*, 16*b* that are positioned to receive at least a portion of the side edges 14*a*, 14*b* of the visor extension 14, guide-stops 30*a*, 30*b* for guiding and stopping forward movement of the visor extension 14 at the end of travel into the extended position, a latching mechanism 22 for maintaining the visor extension 14 in a retracted position and a pair of biasing members 20*a*, 20*b* (FIG. 4) for biasing the visor extension 14 into an extended position when the latching mechanism 22 is released.

As best shown in FIG. 3, guide tracks 16*a*, 16*b* are spaced on the underside 15*b* of visor 12 so as to receive at least a portion of the first and second side edges 14*a*, 14*b* of the visor extension 14 therein. Visor 12 may be any conventional visor supported on the front 13*a* of the helmet 13, as would be known to those of skill in the art. Visor 12 includes a leading edge 12*a*, a trailing edge 12*b* and a body 15 having a topside 15*a* opposite the underside 15*b*. The tracks 16*a*, 16*b* may be secured in any suitable manner to the underside 15*b* of visor 12, for example by bonding or gluing as would be known to those of skill in the art. Alternately, the tracks 16*a*, 16*b* may be formed as a single, unitary member with the visor 12, for example by injection molding the tracks, or may be secured to the front of the helmet 13 instead of the visor 12. The guide tracks 16*a*, 16*b* are also sized to accommodate the side edges 14*a*, 14*b* of the visor extension 14 therein.

Figure 5:
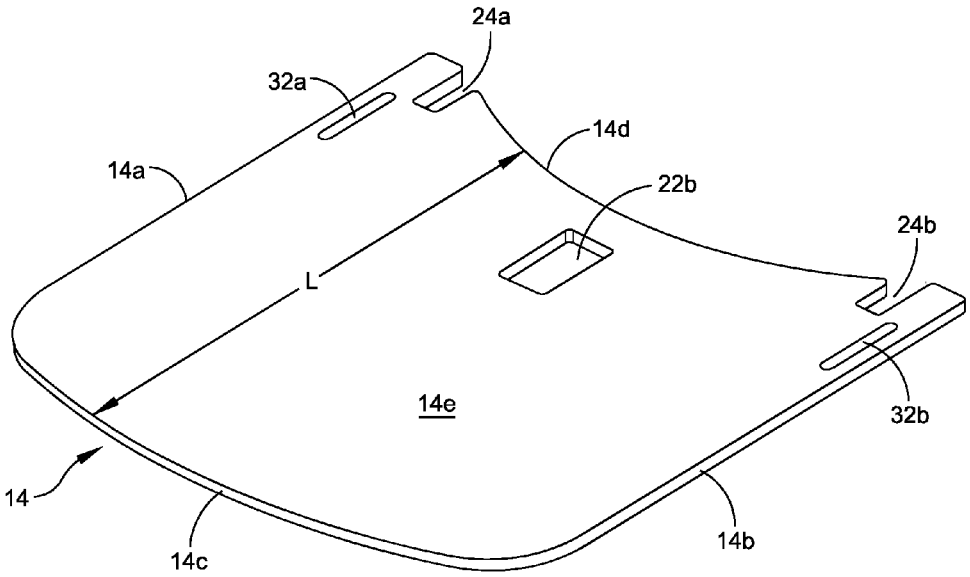
FIG. 5 is a perspective view of the visor extension of the visor assembly of FIG. 1.
Figure 6:
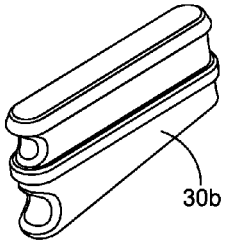
FIG. 6 is a perspective view of the guide-stop of the visor assembly of FIG. 1.
Figure 7:
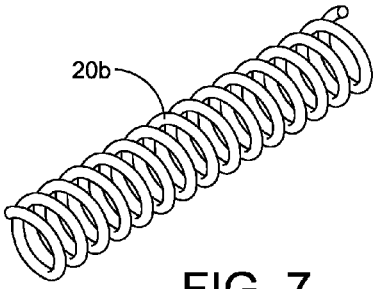
FIG. 7 is a perspective view of the biasing member of the visor assembly of FIG. 1.
Figure 8:
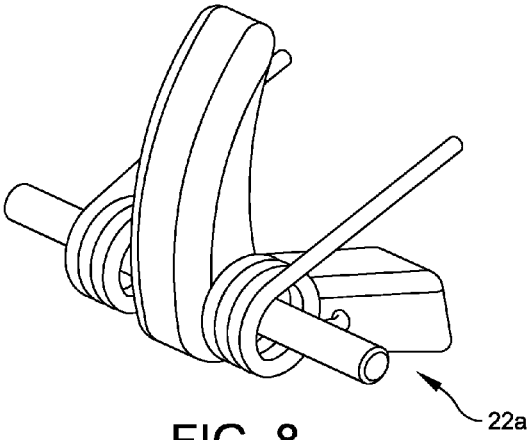
FIG. 8 is a perspective view of the latching mechanism of visor assembly of FIG. 1.
Figure 9:
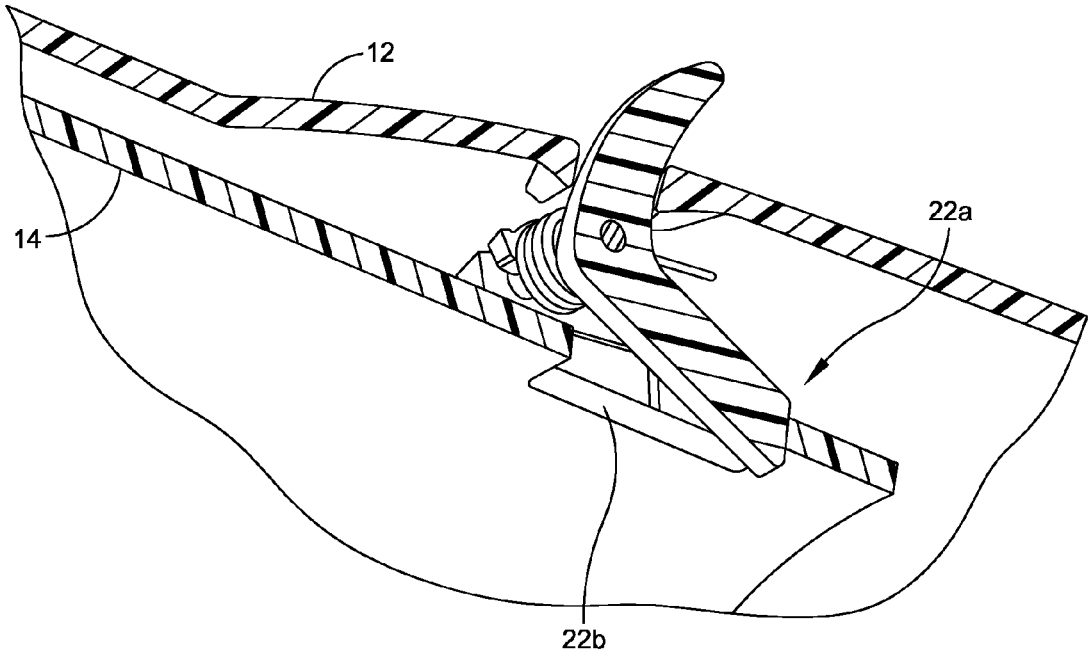
FIG. 9 is a cross-sectional view of the latching mechanism in the engaged position taken along line 9-9 of FIG. 2.
Figure 19:
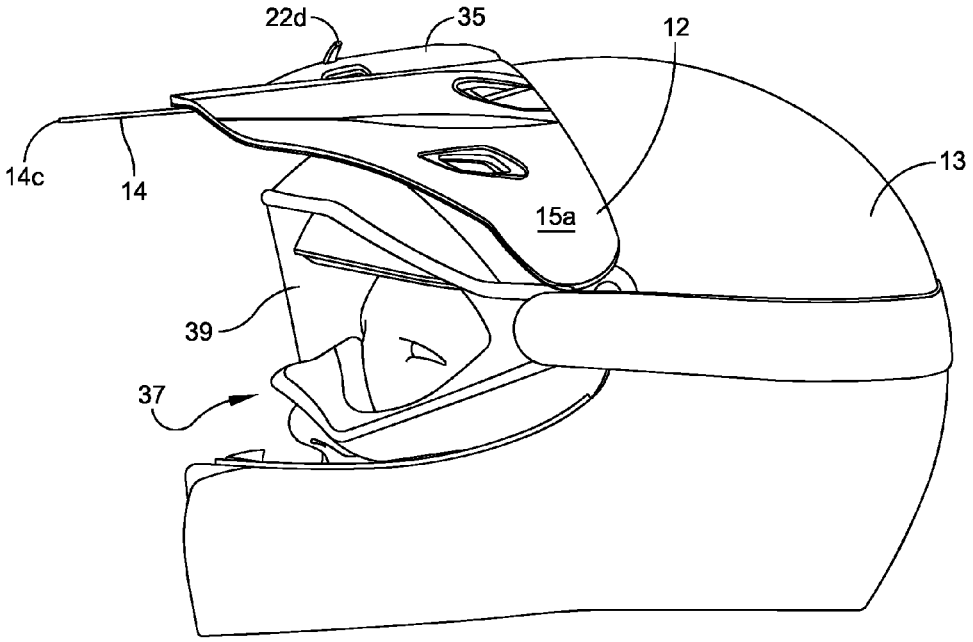
FIG. 19 is a side view of the helmet with the visor assembly of FIG. 1 in the extended position with a rider illustrated.

As best shown in FIG. 5, visor extension 14 includes side edges 14*a*, 14*b*, leading edge 14*c*, trailing edge 14*d*, a first surface 14*e* and a second surface 14*f* (FIG. 3). Visor extension 14 may be made from an impact-resistant piece of thin plastic material, such as Lexan® available from SABIC, that may be clear or shaded to provide protection from the sun. The visor extension 14 has a length "L" between the leading and the trailing edge, sized such that when the visor extension 14 is in use it provides added protection from debris to the rider without covering face opening 26 in a manner that would be undesirable (FIG. 19). Although the visor extension may be designed in different lengths, as would be known to those of skill in the art, the length "L" is about 4-5 inches in the present embodiment and can extend between about 1-3" further than the leading edge 12*a* of visor 12 so as to extend the operational length of the visor. The leading and trailing edges 14*c*, 14*d* may also be curved as illustrated, or may be a straight edge if desired. Visor extension 14 may further include slotted portions 24*a*, 24*b* that may be provided at the trailing edge 14*d* and sized to receive corresponding biasing members 20*a*, 20*b*, and mounting openings 32*a*, 32*b* that are sized to receive corresponding guide-stops 30*a*, 30*b*.

Figure 4:
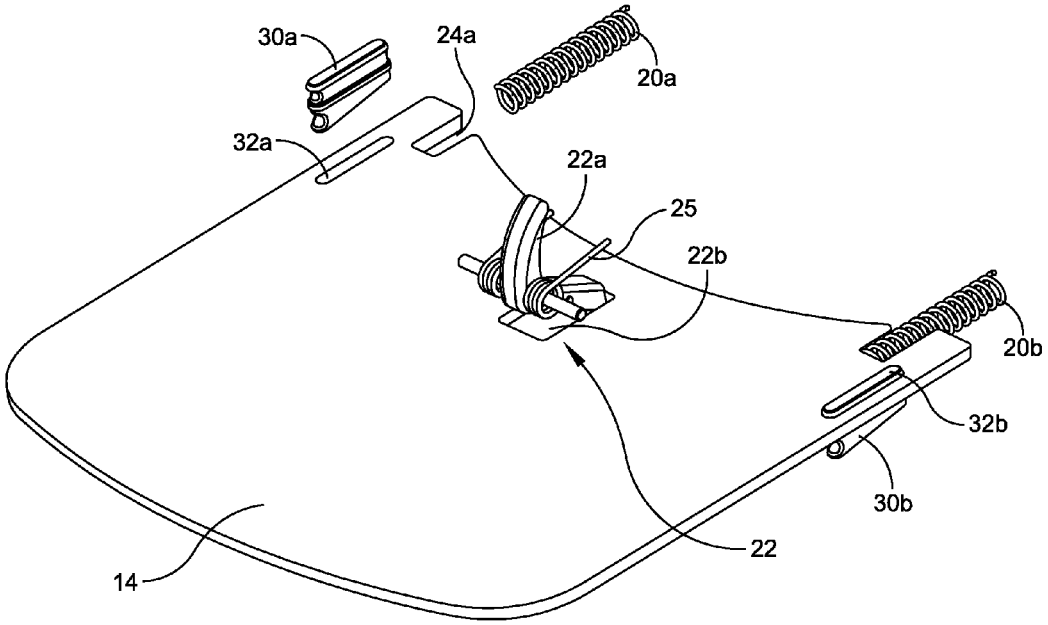
FIG. 4 is a bottom, partially exploded view of the visor extension of FIG. 1.
Figure 10:
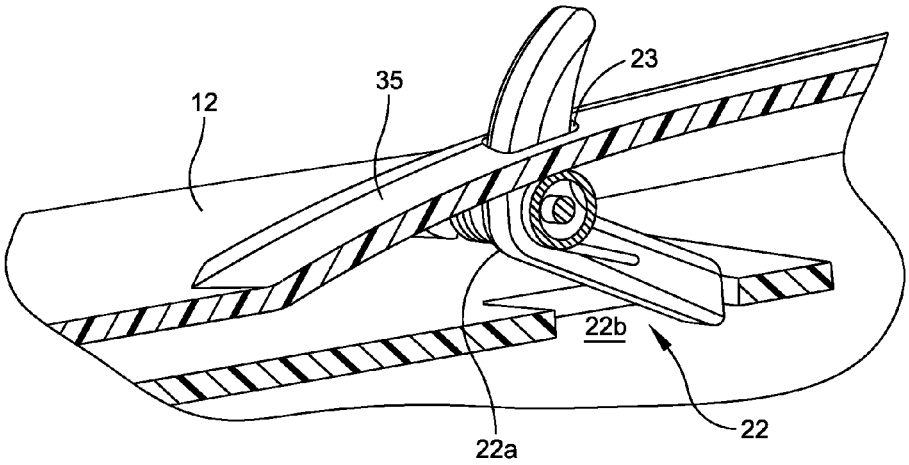
FIG. 10 is a partial cross-sectional view of the latching mechanism of FIG. 9 in the engaged position.
Figure 11:
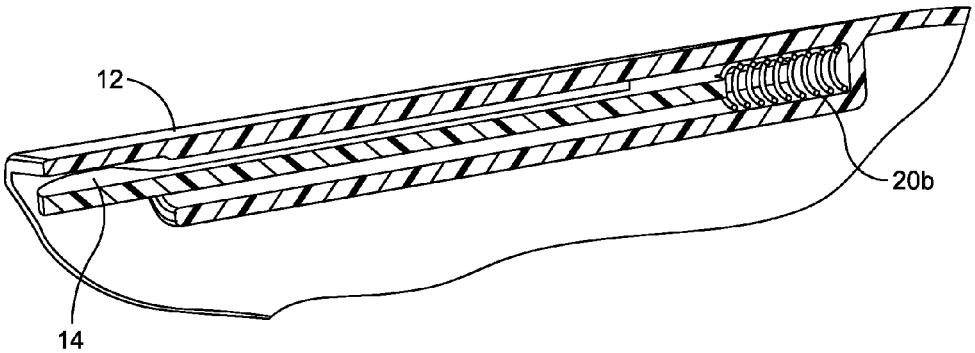
FIG. 11 is a cross-sectional view of the visor assembly of FIG. 1 in a retracted position.
Figure 12:
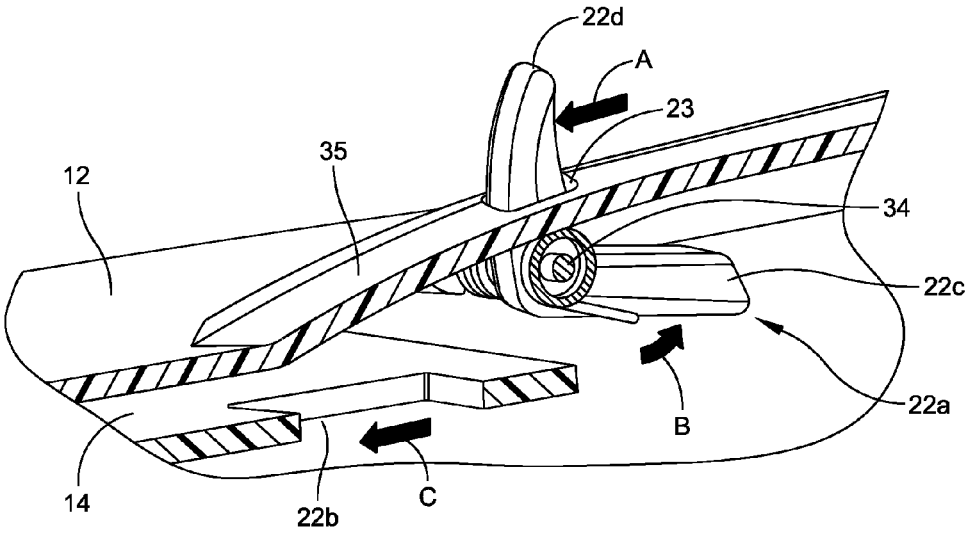
FIG. 12 is a cross-sectional view of the latching mechanism of FIG. 10 illustrating disengagement.
Figure 14:
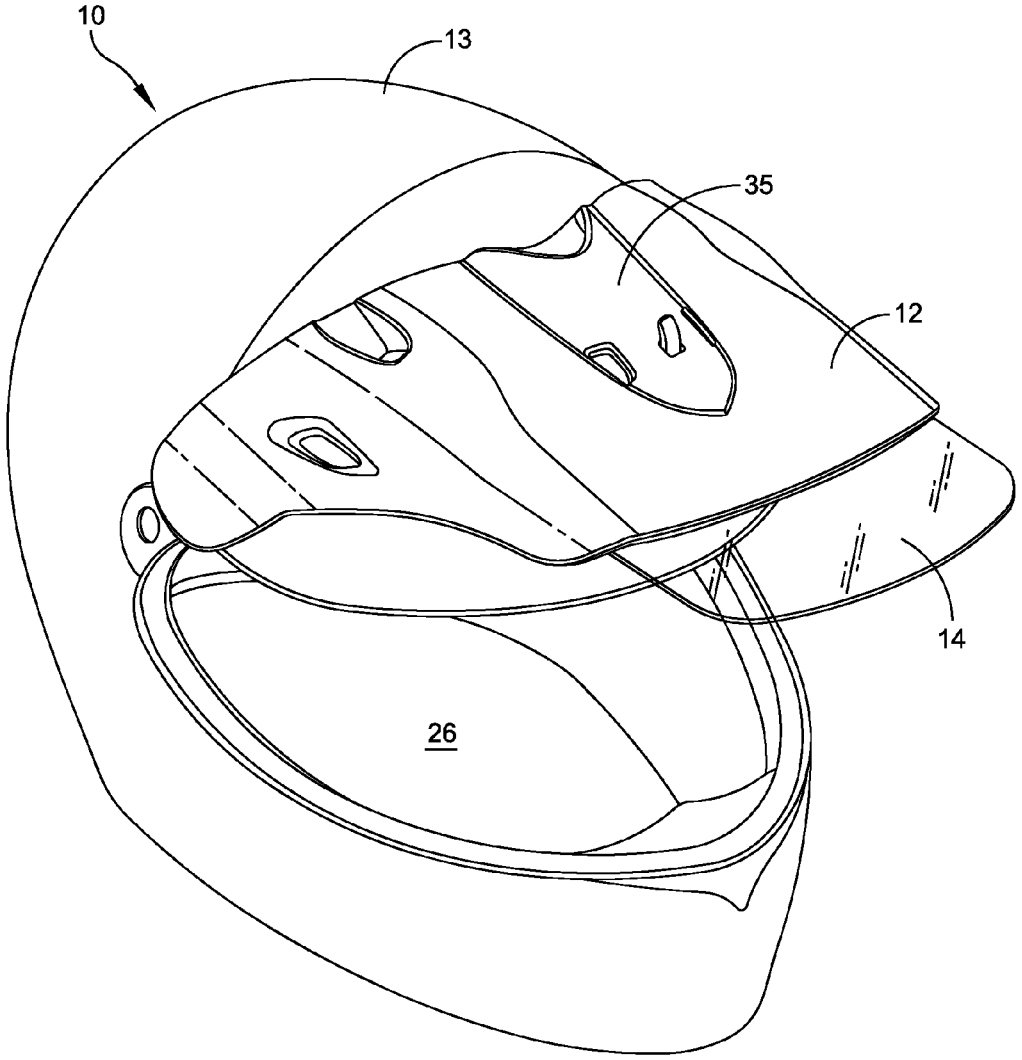
FIG. 14 is a front, perspective view of the helmet with a visor assembly of FIG. 1 in the extended position.
Figure 15:
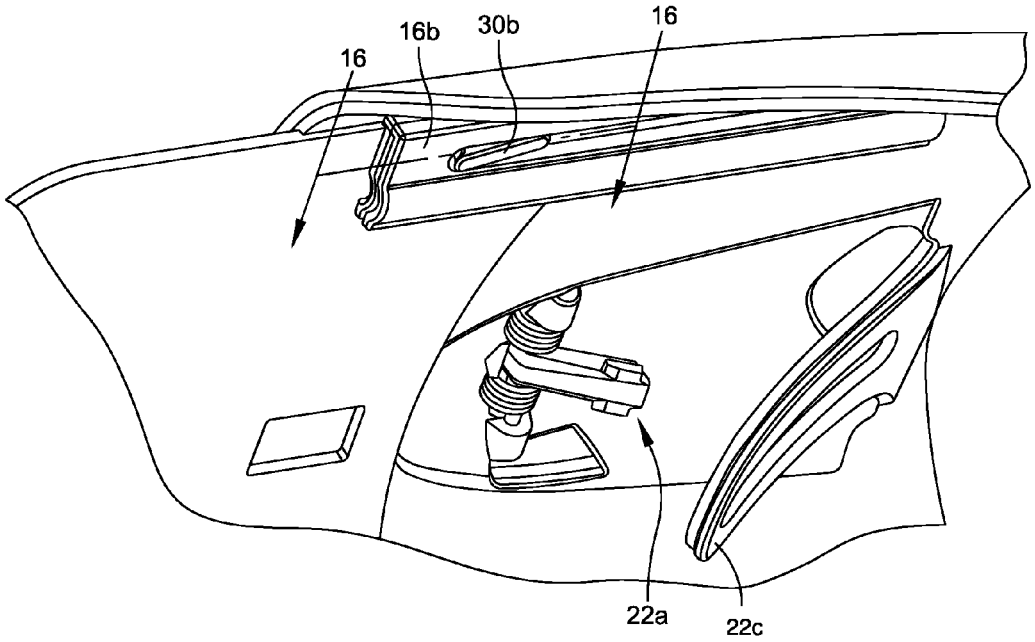
FIG. 15 is a partial bottom view of the visor assembly of FIG. 1 in the extended position.

With reference now to FIG. 4, biasing members 20*a*, 20*b* may be springs, for example a compression spring as illustrated, or other types of springs including but not limited to spiral springs, torsion springs, air springs or hydraulic springs, or other biasing members as would be known to those of skill in the art. In the retracted position as shown in FIG. 11, biasing members 20*a*, 20*b* are held in compression by the visor extension 14 which is held in the retracted position by latching mechanism 22 (FIG. 10). The latching mechanism 22 includes a pivoting latching member 22*a* that engages slot or opening 22*b* disposed in the visor extension 14 in order to hold the visor extension 14 in the retracted position against the force of the biasing members 20*a*, 20*b*. The latching mechanism 22 may also optionally include a clip 22*c* which aids in securing the visor extension 14 that engages the trailing edge 14*d*. In the present embodiment the pivoting latching member 22*a* also extends through an opening 23 in the visor 12 to provide an actuation portion 22*d* that can be easily actuated by a user in order to pivot latching member 22*a* from engagement with opening 22*b*. Latching member 22*a* is also biased through opening 23 by spring 25 so that the actuation portion 22*d* remains in position within the opening 23 after actuated. When latching member 22*a* is released from opening 22*b*, the biasing members 20*a*, 20*b* are released from compression and move the visor extension 14 from the retracted position (FIG. 1) to an extended position (FIG. 14).

Figure 20:
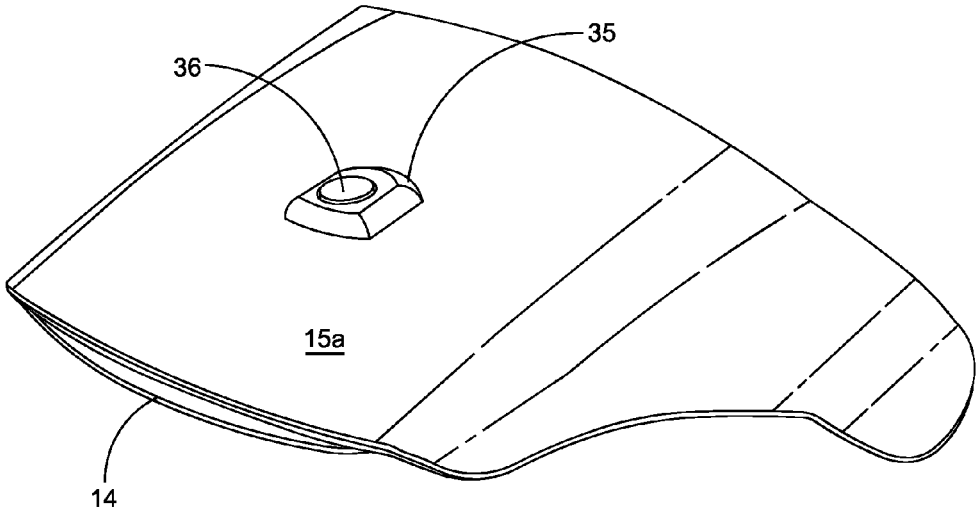
FIG. 20 is a perspective view of an alternate embodiment the visor assembly of FIG. 1 with a button.

Actuation portion 22*d* is preferably raised relative to the topside 15*a* of the visor body 15 so that the rider can easily find the actuation portion 22*d* in order to release the actuation mechanism 22. As described herein above, motocross riders must pay attention to a number of factors when riding including changing track conditions, other riders as well as debris, often while wearing gloves and riding at high speeds. The ability to quickly reach up and locate the actuation portion 22*d* allows for quick, easy and reliable deployment of the visor extension 14. In addition, the actuation portion 22*d* is designed to move in a forward direction, toward the leading edge 12*a* of the main visor 12, so that flying debris will not inadvertently release the visor extension 14 by hitting and engaging the actuation portion 22*d*, which could happen if the actuation portion was designed to actuate rearward instead of forward. To aid a rider in locating the actuation portion 22*d* a bevel 35 may be provided that is raised relative to the surface of the topside 15*a* of visor body 15. Providing the bevel 35 has the additional advantage of helping prevent the actuation portion 22*d* from being accidently engaged. In addition to the foregoing, actuation portion 22*d* may have alternate configurations, provided that it release the latching mechanism from engagement with the visor extension 14, and may additionally be activated by a button 36 which covers opening 23 (FIG. 20). However, the provision of a button 36 may make finding the actuation portion more difficult as it is not raised to the extent of the actuation portion 22*d* and requires the rider to push down rather than simply swiping the actuation portion 22*d*, as described herein below.

Figure 13:
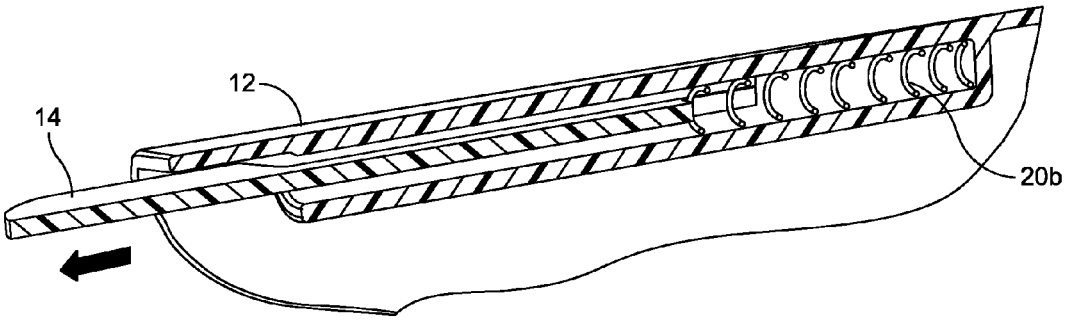
FIG. 13 is a cross-sectional view of the visor assembly of FIG. 1 moving toward the extended position.
Figure 16:
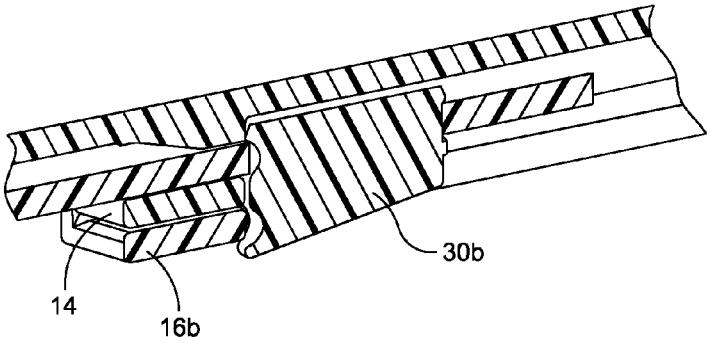
FIG. 16 is a cross-sectional view taken along lines 16-16 of FIG. 15.
Figure 17:
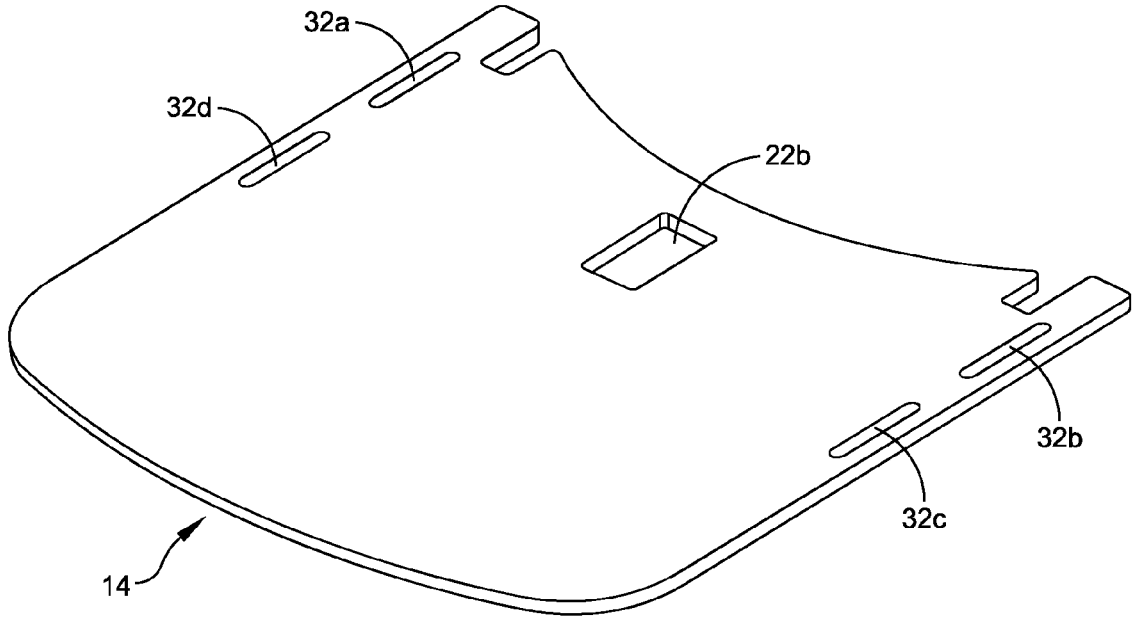
FIG. 17 is a perspective view of an alternate embodiment of the visor extension of FIG. 1.

Operation of latching mechanism 22 will now be described with reference to FIGS. 12-17. In order to disengage the distal end 22*c* of latching member 22*a* from opening 22*b*, the actuation portion 22*d* is moved in the direction indicated by arrow "A" by the rider pushing the actuation portion 22*d* forward toward the leading edge 12*a*, for example by swiping his/her hand over the top of the helmet such that the actuation portion is engaged. As the actuation portion 22*d* is moved in the direction of arrow "A", that the latching member 22*a* rotates about pin 34 within opening 23 thereby moving the distal end 22*c* of the latching member 22*a* in the direction of arrow "B" and out of engagement with opening 22*b*. Once the latching member 22*a* is released from engagement with opening 22*b*, the biasing members 20*a*, 20*b* are freed from compression and move the visor extension in the direction of arrow "C" into the extended position as shown in FIGS. 13 and 17.

In order to enable smooth operation of the visor as the biasing members 20*a*, 20*b* expand and move the visor extension 14 from the retracted position to the extended position, the pair of guide-stops 30*a*, 30*b* are provided. As best shown in FIGS. 3-4 and 16, guide stops 30*a*, 30*b* are supported within corresponding mounting openings 32*a*, 32*b* in visor extension 14 and are received within travel slots 38*a*, 38*b* disposed in guide tracks 16*a*, 16*b*. The guide-stops 30*a*, 30*b* help maintain the position of the visor extension 14 as it travels within guide tracks 16*a*, 16*b* by keeping the side edges 14*a*, 14*b* of the visor extension straight, i.e. substantially parallel with respect to the guide tracks 16*a*, 16*b*, as the visor extension 14 moves from the retracted to the extended position. The position and length of the mounting openings 32*a*, 32*b* and guide tracks 16*a*, 16*b* determine how far the visor extension 14 protrudes from the leading edge of the stationary visor 12, and can be adjusted to lengthen or shortened how far the visor extension 14 is deployed, as desired. For example, as shown in FIG. 17, multiple sets of mounting openings 32*a*, 32*b* and 32*c*, 32*d* may be provided in order to place the guide stops 30*a*, 30*b* at different positions on visor extension 14, thereby effectively changing length of the visor extension 14 that protrudes beyond leading edge 12*a* of main visor 12 in the extended position. As will be appreciated, the length of the visor extension 14 that protrudes beyond leading edge 12*a* of main visor 12 in the extended position is shorter if the guide stops 30*a*, 30*b* are placed in mounting openings 32*c*, 32*d* (which may be preferred if additional protection from the sun, but not debris is desired), than if placed in mounting openings 32*a*, 32*b*. In order to affect the change of position, the guide stops 30*a*, 30*b* are removed and replaced which can be done prior to or after riding.

As best shown in FIG. 16, the guide-stops 30*a*, 30*b* also stop the forward movement of the visor extension 14 at the end of travel into the extended position by being supported within mounting openings 32*a*, 32*b* and traveling in corresponding travel slots 38*a*, 38*b* disposed in guide tracks 16*a*, 16*b*. In the present embodiment, guide-stops 30*a*, 30*b* are made of an elastomeric material such that they are readily and securely inserted into the mounting openings 32*a*, 32*b* and corresponding travel slots 38*a*, 38*b*, are moveable therein and are also removable by a user. By removing the guide-stops 30*a*, 30*b* from the mounting openings 32*a*, 32*b* and corresponding travel slots 38*a*, 38*b* the visor extension 14 can travel beyond the end of the guide tracks 16*a*, 16*b* in order to allow for replacement or cleaning of visor extension 14.

Figure 18:
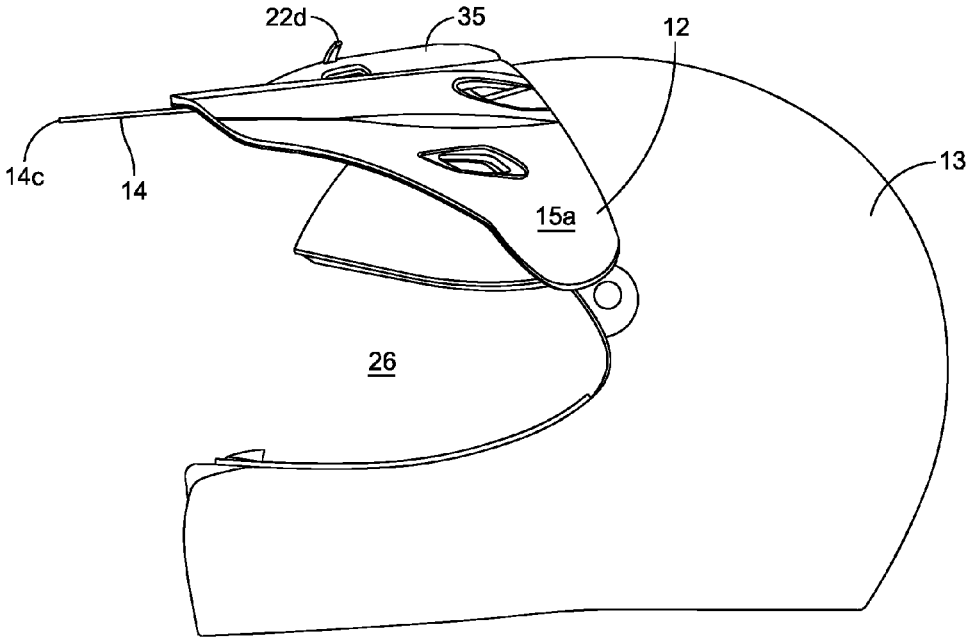
FIG. 18 is a side view of the helmet with the visor assembly of FIG. 1 in the extended position.

Once in the extended position (FIGS. 18-19), the visor extension 14 provides added protection to a rider 37 from sun and debris which could hit the rider's face or goggles 39, without covering the face opening 26 in order to allow for the flow of air into the helmet, and without compromising the design of the helmet 13. The rider can extend the visor extension 14 easily with a single hand (gloved or un-gloved) in an automatic fashion as described herein above, without drawing attention of the rider away from the track or other riders. When not needed, the visor can be stored out of the way simply by the rider pushing on the leading edge 14*c* of the visor extension 14 in a rearward direction, i.e. toward the helmet 13 and toward the leading edge 12*a* of the visor 12, in order to engage the locking member 22*a* with locking opening 22*b* to secure the visor extension 14 in the retracted position.

It will be understood by those skilled in the art that various changes in form and details may be made without departing from the spirit and scope of the invention as defined by the appended claims. For example, the materials disclosed herein may be readily changed, as may the dimensions and geometric configurations of the components described herein, i.e. the visor extension can have other shapes and sizes. As used herein "slot" and "opening" are not limited to configurations that pass through from one surface to another, but can have a base and be more "groove-like" provided that the functionality remains. Also, the visor assembly may find use with helmets other than motocross helmets, and is not limited thereto. Therefore, the above description should not be construed as limiting, but merely as exemplifications of preferred embodiments. Those skilled in the art will envision other modifications within the scope, spirit and intent of the invention.

What is claimed is:

1. A visor assembly for use with a helmet comprising:

a visor supported by the helmet and including a visor body having a topside, an underside opposite the topside and an opening in the body disposed between the topside and the underside, the visor supported on the helmet and extending a certain length outward, beyond at least a top portion of the helmet;

a movable visor extension constructed and arranged to increase the length of the visor including a leading edge, a trailing edge opposite the leading edge, and a pair of side edges;

two or more guide tracks constructed and arranged to guide the visor extension into an extended position, where the visor extension is held above a face opening of the helmet in the extended position;

a latching mechanism including an opening disposed in the visor extension and a latching member constructed and arranged to engage the opening in the visor extension in order to hold the visor extension in a retracted position, the latching member further having an actuation portion extending through the opening in the visor and a distal end engaging the opening in the visor extension;

at least one biasing member constructed and arranged to bias the visor extension into the extended position upon release of the latching mechanism, the at least one biasing member being held in compression by the latching mechanism when the visor extension is in the retracted position; and wherein during use in order to move the visor extension from the retracted position to the extended position a user engages the actuation portion of the visor to move it in a forward direction, toward the leading edge of the visor extension thereby also moving the latching member out of engagement with the opening in the visor extension, wherein the at least one biasing member forces the visor extension in the forward direction into the extended position.

2. The visor assembly of claim 1, wherein the guide tracks are constructed and arranged to receive at least a portion of the side edges of so that the side edges travel within the guide tracks to the extended position.

3. The visor assembly of claim 2, further comprising one or more guide-stops supported by the visor extension, the one or more guide-stops being further constructed and arranged to guide movement of the visor extension within corresponding slots disposed in the two or more guide tracks and to stop forward movement of the visor extension at end of travel of the visor extension into the extended position.

4. The visor assembly of claim 3, further comprising at least one slot in the visor extension sized to receive the at least one biasing member and at least one opening in the visor extension sized to receive the one or more guide-stops.

5. The visor assembly of claim 4 wherein the at least one biasing member is a spring.

6. The visor assembly of claim 1, wherein the latching member includes a pin about which the latching member pivots during use, and the latching member further including a biasing member in order to maintain the actuation portion within the opening in the visor body after the actuation portion has been engaged by a user and the visor extension moved into the extended position.

7. The visor assembly of claim 1, further comprising a bevel supported and raised relative to the topside of visor body, the opening in the visor being disposed through the visor body, and sized to receive the actuation portion of the latching member.

8. The visor assembly of claim 1, in combination with the helmet.

9. The visor assembly of claim 8, wherein the visor extension in the extended position provides protection from debris to the face of a user without covering the face opening so as to allow for ventilation.

10. A visor assembly for use with a helmet comprising:

a visor supported by the helmet and including a body having a topside, and an underside opposite the topside;

a movable visor extension including a leading edge, a trailing edge opposite the leading edge, and a pair of side edges;

two or more guide tracks constructed and arranged to receive at least a portion of the side edges of the visor extension, the two or more guide tracks each including an opening disposed therein defining the length of travel of the visor extension between a first, retracted position and a second, extended position;

a latching mechanism including an opening disposed in the visor extension and a latching member constructed and arranged to engage the opening in the visor extension in order to hold the visor extension in the first, retracted position;

at least one biasing member constructed and arranged to bias the visor extension into the second, extended position upon release of the latching mechanism from engagement with the opening; and one or more guide-stops supported within one or more corresponding openings in the visor extension and disposed within the corresponding slots in the two or more guide tracks; and wherein during use in order to move the visor extension from the first, retracted position to the second, extended position a user engages the latching member so as to move the latching member out of engagement with the opening in the visor extension, wherein the at least one biasing member forces the visor extension in the forward direction so that the guide-stops guide movement of the visor extension within the corresponding slots disposed in the two or more guide tracks and stop forward movement of the visor extension in the extended position.

11. The visor assembly of claim 10, wherein the latching member further includes an actuation portion extending through an opening in the visor body.

12. The visor assembly of claim 11, further comprising a bevel supported and raised relative the topside of visor body, the opening in the visor being disposed through the visor body and the bevel and sized to receive the actuation portion of the latching member.

13. The visor assembly of claim 11, wherein the latching member includes a pin about which the latching member pivots during use, and the latching member further including a biasing member in order to maintain the actuation portion within the opening in the visor body after the actuation portion has been engaged by a user and the visor extension moved into the extended position.

14. The visor assembly of claim 10, further comprising at least one slot in the visor extension sized to receive the at least one biasing member.

15. The visor assembly of claim 14, wherein the at least one biasing member is a spring.

16. The visor assembly of claim 10, in combination with the helmet.

17. The visor assembly of claim 16, wherein the helmet includes a body having a face opening disposed therein and wherein the visor extension in the extended position provides protection from debris to the face of a user without covering the face opening so as to allow for ventilation.

18. A protective assembly for the head comprising:

a helmet including a body having a face opening disposed therein;

a visor supported by the helmet above the face opening, the visor including a body having a topside, an underside opposite the topside and an opening in the body disposed between the topside and the underside;

a movable visor extension including a leading edge, a trailing edge opposite the leading edge, and a pair of side edges;

two or more guide tracks constructed and arranged to receive at least a portion of the side edges of the visor extension, the two or more guide tracks each including an opening disposed therein defining the length of travel of the visor extension between a first, retracted position and a second, extended position;

a latching mechanism including an opening disposed in the visor extension and a latching member constructed and arranged to engage the opening in the visor extension in order to hold the visor extension in a first, retracted position, the latching member further having an actuation portion extending through the opening in the visor and a distal end engaging the opening in the visor extension;

at least one biasing member constructed and arranged to bias the visor extension into a second, extended position upon release of the latching mechanism, the at least one biasing member being held in compression by the latching mechanism when the visor extension is in the first, retracted position;

one or more guide-stops supported within one or more corresponding openings in the visor extension and disposed within the corresponding slots in the two or more guide tracks; and wherein during use in order to move the visor extension from the first, retracted position to the second, extended position a user engages the actuation portion of the visor to move it in a forward direction, toward the leading edge of the visor extension thereby also moving the distal end of the latching member out of engagement with the opening in the visor extension, wherein the at least one biasing member forces the visor extension in the forward direction so that the guide-stops guide movement of the visor extension within the corresponding slots disposed in the two or more guide tracks and stop forward movement of the visor extension in the extended position.

19. The visor assembly of claim 18, wherein the latching member further including a biasing member in order to maintain the actuation portion within the opening in the visor body after the actuation portion has been engaged by a user and the visor extension moved into the extended position.

20. The visor assembly of claim 18, further comprising a bevel supported and raised relative the topside of visor body, the opening in the visor being disposed through the visor body and the bevel and constructed and arranged to receive the actuation portion of the latching member.

* * * * *